US006566138B1

(12) United States Patent
Seitzinger et al.

(10) Patent No.: US 6,566,138 B1
(45) Date of Patent: May 20, 2003

(54) CHEMICAL AGENT SIMULANT TRAINING COMPOSITION

(75) Inventors: Alan T. Seitzinger, Abingdon, MD (US); James A. Genovese, Street, MD (US)

(73) Assignee: The United States of America as represented by the Secretary of the Army, Washington, D.C., MD (US)

( * ) Notice: Subject to any disclaimer, the term of this patent is extended or adjusted under 35 U.S.C. 154(b) by 0 days.

(21) Appl. No.: 09/184,463

(22) Filed: Oct. 26, 1998

(51) Int. Cl.[7] ..... G01N 31/00; G01N 33/00

(52) U.S. Cl. ..... 436/8; 436/9; 436/104; 252/408.1; 588/200

(58) Field of Search ..... 436/8, 9, 104; 252/408.1; 588/200

(56) References Cited

U.S. PATENT DOCUMENTS 3,634,278 A * 1/1972 Wolverton ..... 252/192
3,844,905 A * 10/1974 Epstein et al. ..... 205/785.5
3,972,783 A * 8/1976 Poziomek et al. ..... 205/779.5
4,523,043 A * 6/1985 Pytlewski et al. ..... 568/840
4,869,934 A * 9/1989 Jethwa ..... 427/393.5
5,019,518 A * 5/1991 Diehl et al. ..... 436/172
5,032,380 A * 7/1991 Novak et al. ..... 424/7.1
5,100,477 A * 3/1992 Chromecek et al. ..... 134/7
5,126,309 A * 6/1992 Chromocek et al. ..... 502/402
5,206,175 A * 4/1993 Rossmann et al. ..... 436/106
5,256,192 A * 10/1993 Liu et al. ..... 106/21
5,667,569 A * 9/1997 Fujioka ..... 106/38.58
5,698,614 A * 12/1997 Ueda et al. ..... 523/161
5,722,835 A * 3/1998 Pike ..... 434/218
5,759,861 A * 6/1998 Christie et al. ..... 436/119

OTHER PUBLICATIONS

United States Statutory Invention Registration H270; Hovanec, May 1987.*
"Acute Ecological Toxicity and Environmental Persitence of Simulants". Cataldo et al, 1989.*
"Development of Candidate Chemical Simulant List . . . ". Little, May 1987.*

* cited by examiner

*Primary Examiner*—Jill Warden
*Assistant Examiner*—L. Cross
(74) *Attorney, Agent, or Firm*—Ulysses John Biffoni

(57) ABSTRACT

A composition for simulating and evaluating chemical agent contamination which can be used to safely train military personnel in handling chemical agent contamination. It has a vapor generating component having a vapor pressure of from about 0.1 to about 30 mm Hg at 25° C.; a fluorescent dye; and a solvent which uniformly disperses the vapor generating component and fluorescent dye.

31 Claims, No Drawings

CHEMICAL AGENT SIMULANT TRAINING COMPOSITION

GOVERNMENT INTEREST

The invention described herein may be manufactured, licensed, and used by or for the U.S. Government.

BACKGROUND OF THE INVENTION

1. Field of the Invention

The present invention relates to a composition suitable for simulating and evaluating chemical agent contamination. More particularly, the invention provides compositions which can be used to safely train military personnel in handling chemical agent decontamination.

2. Description of the Prior Art

The handling of chemical agent contamination is an important part of military training. The exposure of military personnel even to small amounts of real contaminants, i.e. nerve and/or blistering agents is impractical due to the risk of injury involved. There is therefore a need to use a relatively harmless composition which simulates the effects of such chemical agent contaminants without injuring trainees. The invention therefore provides a chemical agent simulant composition for operational evaluation of chemical agent contamination. It is useful for providing a measure of the extent of contamination from spills or dispersion devices, and the effectiveness of decontamination procedures. The inventive composition employs a unique combination of compatible detection materials which are environmentally safe and incorporate simulated vapor signature components, as well as a liquid fluorescence signature component. It provides a simulant chemical agent vapor signature for chemical detection systems, as well as a visible indicator of liquid contamination when irradiated with an ultraviolet light source. This system can be useful for determination of the extent of aerosol or droplet depositions as well. Certain compositions of this system can also be detected using military chemical agent detection papers such as the U.S. Military's M8 or M9 detection papers. These papers utilize specific dye chemistries that also could be utilized to detect various levels of liquid droplet contamination.

The invention provides a relatively safe and environmentally friendly training aid for liquid G-agent (i.e., nerve agent, including VX) and H-agent (mustard-HD) simulants having varying viscosity. A preferred G agent simulant according to the invention would be a liquid mixture of dipropylene glycol monomethyl (DPGME), a fluorescent dye and a solvent such as polyethylene glycol (PEG-200) or water. The H-agent simulant is a liquid mixture of methyl salicylate (MS), a fluorescent dye and a solvent. DPGME, MS, and PEG-200 all have each been used individually and in certain combination for years as chemical agent simulants. The ion mobility characteristics of the functional groups associated with DPGME and MS lends itself well for detectability using ion mobility spectrometers (i e. the Chemical Agent Monitor (CAM)). In addition, MS and DPGME vapors can be detected by infrared, surface acoustic wave (SAW) and several other detection or monitoring technologies. DPGME and MS have been applied to random test personnel, equipment and vehicles, so the CAM could be operationally used to sort contaminated from clean personnel or materiel. Fluorescent brightening agents have been added as a fluorescence tracer to PEG-200 to see how well the simulant was applied to contaminated test vehicles. M8 or M9 detection papers can also be used to verify gross liquid or droplet contamination The prior art to date has not produced a G or H chemical agent training simulant having the combined attributes of being a relatively innocuous material, good simulant agent liquid and vapor property correlation, a visual confirmation using a fluorescent whitening agent to show the extent of liquid contamination present, vapor signature detection by several technologies, and an actual chemical reaction simulating neutralization occurring between the training chemical agent simulant and an actual applied decontamination solution. At present, only the physical removal of decontamination procedures (i.e., soap & water, scrub brushes) can be evaluated. Therefore, present decontamination training operations using chemical agent simulants can only evaluate the mechanical process of contamination removal. Training with the present composition would simulate both the chemical neutralization and physical removal of the contamination. This system would provide a much better method for contamination assessment and decontamination effectiveness, to be used in training of military and hazardous materials responders.

The invention provides relatively safe, environmentally friendly (i.e., non-listed Resource Conservation Recovery Act (RCRA)) chemical mixtures that can be used to demonstrate a G or H agent liquid or vapor behavior and simulate the neutralization reaction which occurs when the simulant is exposed to a decontamination solution. The fluorescent tracer added to the simulants allows a visual confirmation of contamination present before and after decontamination procedures with the use of an UV lamp. The chemical agent simulants can be thickened in various degrees by adding a thickening agent such as polymethyl methacrylate polymer in order to achieve the desired liquid or liquid mixture viscosity.

SUMMARY OF THE INVENTION

The invention provides a chemical agent simulant composition which comprises:

(a) at least one vapor generating component having a vapor pressure of from about 0.1 to about 30 mm Hg at 25° C. which is present in an amount sufficient to be detectable by vapor detection apparatus;

(b) at least one fluorescent dye in an amount sufficient to be visibly detectable when irradiated by ultraviolet light; and (c) at least one solvent in an amount sufficient to form a substantially uniform dispersion of the vapor generating component and the fluorescent dye.

The invention also provides a method of simulating the presence of chemical agents on a surface which comprises:

i) contacting a surface with the above chemical agent simulant composition: and ii) detecting at least one of the vapor generating component and the fluorescent dye. In some circumstances the simulant solve system may also be detected using liquid detector dye papers such as M8 or M9 detector papers.

The invention further provides a method of simulating the decontamination of a surface with a chemical agent which comprises:

i) contacting a surface with the above chemical agent simulant composition;

ii) detecting at least one of the vapor generating component and the fluorescent dye;

iii) chemically modifiying the chemical agent simulant composition; and iv) optionally redetecting the presence or absence of at least one of the vapor generating components and/or the fluorescent dye to determine the effectiveness of the decontamination.

DETAILED DESCRIPTION OF THE PREFERRED EMBODIMENT

In the practice of the present invention, a chemical agent simulant composition is prepared which is composed of at least one vapor generating component having a vapor pressure of from about 0.1 to about 30 mm Hg at 25° C.; at least one fluorescent dye; and at least one solvent.

The vapor generating component can be any material having a vapor pressure of from about 0.1 to about 30 mm Hg at 25° C. Such non-exclusively include fragrances, flavorants, and such materials as methyl salicylate, diethylene glycol monomethyl ether, dipropylene glycol monomethyl ether, diethyl malonate, dimethyl sulfoxide, butyl mercaptan isoamyl acetate, dimethyl methyl phosphonate, methyl benzoate, n-dodecane thiol, butyl salicylate, cyclohexanone, dihexylether, dypnone, n-ammnopropyl morpholine, n-(2-hydroxyethyl) morpholine, di(2-ethylhexyl)ether, 2-undecanol, 2-hydroxyethyl-n-octyl sulfide, n,n-diethyl-m-toluamide, n-octyldecanethiol, phenyl ethyl phenyl acetate, clove oil, peppermint oil, and mixtures thereof. Preferably the vapor generating component comprises dipropylene glycol monomethyl ether, methyl salicylate or a mixture of dipropylene glycol monomethyl ether and methyl salicylate. The vapor generating component is preferably present in the composition in an amount of from about 5% to about 80% by weight of the composition. A more preferred range is from about 5% to about 50% and most preferably from about 5% to about 20%.

The composition then contains a fluorescent dye component. The fluorescent dye may comprise a component such as stilbenes, coumarins, triazines, thiazoles, benzoxazoles, xanthenes, triazoles, oxazoles, thiophenes, pyrazolines, derivatives of naphthalene dicarboxylic acids, derivatives of heterocyclic dicarboxylic acids, derivatives of cinnamic acid and mixtures thereof Examples of suitable fluorescent dyes nonexclusively include 2,2'-(thiophenediyl)-bis-(t-butyl benzoxazole); 2-(stilbyl-4")-(naphtho-1',2'4,5)-1,2,3-triazole-2"-sulfonic acid phenyl ester; and 7-(4'-chloro-6"-diethylamino-1',3',5'-triazine4'-yl)amino-3-phenyl coumarin. Other useful fluorescent dyes include those described in U.S. Pat. Nos. 2,784,183; 3,644,394 and "The Production and Application of Fluorescent Brightening Agents" by Milos Zahradnik, John Wiley & Sons, New York, 1982. The fluorescent dye component is preferably present in the overall composition in an amount of from about 0.05% to about 0.5%, more preferably from about 0.05% to about 0.25% and most preferably from about 0.5% to about 0.1%. The most preferred fluorescent dyes are available commercially as Tinopol CBS-X and Tinopol FRP from Ciba Geigy.

The composition then contains a solvent capable of substantially uniformly dispersing the other composition components. "Substantially uniformly dispersed" means that the vapor-generating component and the fluorescent dye component are contained in a dispersion at a relatively uniform concentration throughout the dispersion. Of course, a "dispersion" comprises a system consisting of a dispersed substance and the medium in which it is dispersed. In addition, the dye component and the vapor generating component do not react or otherwise interfere with one another, remaining independent entities in solution. Suitable solvents nonexclusively include water, polyethylene glycol, methyl methyacrylate, glycols, glycerol, trialkylanines, vinyl alcohol, urea, $C_1$ to $C_4$ alcohols, and mixtures thereof. The most preferred solvents are water and polyethylene glycol such as PEG-200 which is a polyethylene glycol having an average molecular weight of about 200. The solvent is preferably present in an amount of from about 20% to about 90% by weight of the composition, more preferably from about 20% to about 50% and most preferably from about 20% to about 25%.

The composition may further comprise one or more components useful for maintaining shelf life and precluding environmental breakdown of the components in the composition. Such may include buffering agents such as carbonate and phosphate buffers which maintain pH; thickening agents such as polymethyl methacrylate; and surfactants such as natural and synthetic soaps, particularly anionic, cationic and nonionic surfactants. These optional components, when they are used, may be present in an amount of from about 0.05% to about 5% by weight of the composition, more preferably from about 0.05% to about 3% and most preferably from about 0.05% to about 2%.

A preferred embodiment of a G agent simulant is a liquid mixture of dipropylene glycol methyl ether (DPGME), a fluorescent dye and a solvent such as polyethylene glycol or water. The preferred H-agent simulant is a liquid mixture of methyl salicylate (MS), a fluorescent dye and a solvent.

The simulant composition is used by applying it, such as by spraying or brushing onto a surface, which may include the skin and clothing of military personnel, as well as equipment. The vapors of the simulant composition can be detected by a variety of equipment such a ion mobility spectrometers, Chemical Agent Monitors (CAM devices), infrared detectors, and surface acoustic wave detectors, etc. which have been suitably calibrated for the detection of the simulant composition signatures. The vapor characteristics of the composition (i.e., vapor pressure, vapor density, volatility) are comparable to G and H agents and liquid characteristics (i.e., viscosity, liquid density) and can be adjusted accordingly by adding either more solvent or a thickener. The dye can be visibly monitored by shining an ultraviolet light onto the surface applied with the composition. The addition of the dye as a fluorescent tracer does not interfere or react with the corresponding chemical functional groups, which produce the desired detection behavior of MS and DPGME. However, when exposed to an actual decontamination solution, both the vapor generating component and fluorescent component will be chemically modified, i.e. it will degrade or neutralize these signature components, thus simulating their chemical removal via neutralization. In use, after detection of the simulant composition, its chemical modification can be simulated by contacting the chemical agent simulant composition with a mixture of water and a soap, a detergent or bleach such as sodium hypochlorite, a peroxide or other oxidizing agent, followed by a re-testing of the treated area. The chemical modification solution quenches the dye and simulant and removes the vapor and UV visibility signature of the simulant composition. As used in this invention, chemical modification includes a physical removal as well as an in situ neutralization of the chemical agent simulant composition.

The following non-limiting examples serve to illustrate the invention.

EXAMPLE 1

A G-agent (nerve agent) simulant composition is prepared by mixing the following components in parts by weight:

| | |
|---|---|
| dipropylene glycol methyl ether | 50.0 |
| Tinopal CBS-X | 0.1 |
| polymethyl methacrylate | 0.5 |
| polyethylene glycol or water | balance |

The composition is sprayed onto a test surface. An ultraviolet light is irradiated onto the test surface and the simulant composition is visibly observed. A Chemical Agent Monitor (CAM) detects the vapor generating composition. Thereafter the test surface is washed with a solution of water, soap and bleach. An ultraviolet light is again irradiated onto the test surface and the simulant composition is not observed. A Chemical Agent Monitor (CAM) does not detects the vapor generating composition.

EXAMPLE 2

An H-agent (blistering agent) simulant composition is prepared by mixing the following components in parts by weight:

| | |
|---|---|
| methyl salicylate | 50.0 |
| Tinopal CBS-X | 0.1 |
| polymethyl methacrylate | 0.5 |
| polyethylene glycol or water | balance |

The composition is sprayed onto a test surface. An ultraviolet light is irradiated onto the test surface and the simulant composition is visibly observed. A Chemical Agent Monitor (CAM) detects the vapor generating composition. Thereafter the test surface is washed with a solution of water, soap and bleach. An ultraviolet fight is again irradiated onto the test surface and the simulant composition is not observed. A Chemical Agent Monitor (CAM) does not detects the vapor generating composition.

Thus the invention will significantly enhance the training of personnel in chemical agent decontamination procedures; contamination avoidance (i.e., detector use); exit/entry procedures from shelters and vehicles; rendered safe procedures and mitigation techniques involving energetic and nonenergetic devices, and the selection, donning and removal of personnel protective equipment. In addition, the invention can be used by software designers to model liquid chemical agent contamination transfer or vapor clouds in various environments. The invention has not only military training applications, but could also be used in the civilian sector for domestic preparedness hazardous materials training or exercises.

What is claimed is:

1. A chemical agent simulant composition, consisting essentially of:

(a) a vapor generating component comprising methyl salicylate, wherein said methyl salicylate is present in an amount sufficient to be detectable by a vapor detection apparatus;

(b) at least one fluorescent dye component present in an amount sufficient to be visibly detectable when irradiated by ultraviolet light; and (c) at least one solvent present in an amount sufficient to form a substantially uniform dispersion of said vapor generating component and said fluorescent dye, wherein said vapor generating component and said dye component are unreactive and remain independent of one another in said dispersion, and wherein said dispersion can simulate chemical agent contamination that can be detected by a vapor detection apparatus or by detecting fluorescence.

2. The composition of claim 1, wherein said fluorescent dye component comprises one or more components selected from the group consisting of stilbenes, coumarines, triazines, thiazoles, benzoxazoles, xanthenes, triazoles, oxazoles, thiophenes, pyrazolines, derivatives of naphthalene dicarboxylic acids, derivatives of heterocyclic dicarboxylic acids, derivatives of cinnamic acid and mixtures thereof.

3. The composition of claim 1, wherein said solvent is selected from the group consisting of water, polyethylene glycol, methyl methacrylate, glycols, glycerol, trialkyamines, vinyl alcohol, urea, $C_1$ to $C_4$ alcohols, and mixtures thereof.

4. The composition of claim 1, further comprising one or more components selected from the group consisting of buffering agents, thickening agents and surfactants.

5. The composition of claim 4, wherein said thickening agent comprises polymeihyl methacrylate.

6. The composition of claim 1, wherein said vapor generating component is present in an amount of from about 5% to about 80% by weight of the composition.

7. The composition of claim 1, wherein said fluorescent dye component is present in an amount of from about 0.05% to about 0.5% by weight of the composition.

8. The composition of claim 1, wherein said solvent component is present in an amount of from about 20% to about 90% by weight of the composition.

9. The composition of claim 1, further comprising a thickening agent in an amount of from about 0.05% to about 5% by weight of the composition.

10. A chemical agent simulant composition, consisting essentially of:

(a) a vapor generating component comprising a mixture of dipropylene glycol monomethyl ether and methyl salicylate, wherein said vapor generating component is present in an amount sufficient to be detectable by a vapor detection apparatus;

(b) at least one fluorescent dye component present in an amount sufficient to be visibly detectable when irradiated by ultraviolet light; and (c) at least one solvent present in an amount sufficient to form a substantially uniform dispersion of said vapor generating component and said fluorescent dye, wherein said vapor generating component and said dye component are unreactive and remain independent of one another in said dispersion, and wherein said dispersion can simulate chemical agent contamination that can be detected by a vapor detection apparatus or by detecting fluorescence.

11. The composition of claim 10, wherein said fluorescent dye component comprises one or more components selected from the group consisting of stilbenes, coumarines, triazines, thiazoles, benzoxazoles, xanthenes, triazoles, oxazoles, thiophenes, pyrazolines, derivatives of naphthalene dicarboxylic acids, derivatives of heterocyclic dicarboxylic acids, derivatives of cinnamic acid and mixtures thereof.

12. The composition of claim 10, wherein said solvent is selected from the group consisting of water, polyethylene glycol, methyl methacrylate, glycols, glycerol, trialkyamines, vinyl alcohol, urea, $C_1$ to $C_4$ alcohols, and mixtures thereof.

13. The composition of claim 10, further comprising one or more components selected from the group consisting of buffering agents, thickening agents and surfactants.

14. The composition of claim 13, wherein said thickening agent comprises polymethyl methacrylate.

15. The composition of claim 10, wherein said vapor generating component is present in an amount of from about 5% to about 80% by weight of the composition.

16. The composition of claim 10, wherein said fluorescent dye component is present in an amount of from about 0.05% to about 0.5% by weight of the composition.

17. The composition of claim 10, wherein said solvent component is present in an amount of from about 20% to about 90% by weight of the composition.

18. The composition of claim 10, further comprising a thickening agent in an amount of from about 0.05% to about 5% by weight of the composition.

19. A chemical agent simulant composition, consisting essentially of:

(a) a vapor generating component comprising dipropylene glycol monomethyl ether, methyl salicylate or a mixture thereof, and which is present in an amount sufficient to be detectable by a vapor detection apparatus;

(b) at least one fluorescent dye component comprising a stilbene, and wherein said stilbene is present in an amount sufficient to be visibly detectable when irradiated by ultraviolet light; and (c) at least one solvent comprising water, polyethylene glycol or a mixture thereof, said solvent present in an amount sufficient to form a substantially uniform dispersion of said vapor generating component and said fluorescent dye, wherein said vapor generating component and said dye component are unreactive and remain independent of one another in said dispersion, and wherein said dispersion can simulate chemical agent contamination that can be detected by a vapor detection apparatus or by detecting fluorescence.

20. The composition of claim 19, further comprising a thickening agent, said thickening agent comprising polymethyl methacrylate.

21. A chemical agent simulant composition, consisting essentially of:

(a) at least one vapor generating component having a vapor pressure of from about 0.1 to about 30 mm Hg at 25° C. which is present in an amount sufficient to be detectable by a vapor detection apparatus;

(b) at least one fluorescent dye component present in an amount sufficient to be visibly detectable when irradiated by ultraviolet light, and wherein said fluorescent dye component comprises one or more components selected from the group consisting of stilbenes, coumarines, triazines, thiazoles, benzoxazoles, xanthenes, triazoles, oxazoles, thiophenes, pyrazolines, derivatives of nap hthalene dicarboxylic acids, derivatives of heterocyclic dicarboxylic acids, derivatives of cinnamic acid and mixtures thereof; and (c) at least one solvent present in an amount sufficient to form a substantially uniform dispersion of said vapor generating component and said fluorescent dye, wherein said vapor generating component and said dye component are unreactive and remain independent of one another in said dispersion, and wherein said dispersion can simulate chemical agent contamination that can be detected by a vapor detection apparatus or by detecting fluorescence.

22. A chemical agent simulant composition, consisting of:

(a) a vapor generating component, wherein said vapor generating component is selected from the group consisting of methyl salicylate, diethylene glycol monomethyl ether, dipropylene glycol monomethyl ether, diethyl malonate, dimethyl sulfoxide, butyl mercaptan isoamyl acetate, dimethyl methyl phosphonate, methyl benzoate, n-dodecane thiol, butyl salicylate, cyclohexanone, dihexylether, dypnone, n-aminopropyl morpholine, n-(2-hydroxyethyl)morpholine, di(2-ethylhexyl)ether, 2-undecanol, 2-hydroxyethyl-n-octyl sulfide, n,n-diethyl-m-toluamide, n-octyldecanethiol, phenyl ethyl phenyl acetate, clove oil, peppermint oil, and mixtures thereof;

(b) at least one fluorescent dye component present in an amount sufficient to be visibly detectable when irradiated by ultraviolet light; and (c) at least one solvent present in an amount sufficient to form a substantially uniform dispersion of said vapor generating component and said fluorescent dye component, wherein said vapor generating component and said dye component are unreactive and remain independent of one another in said dispersion, and wherein said dispersion can simulate chemical agent contamination that can be detected by a vapor detection apparatus or by detecting fluorescence.

23. The composition of claim 22, wherein said vapor generating component comprises dipropylene glycol monomethyl ether.

24. The composition of claim 22, wherein said fluorescent dye component comprises one or more components selected from the group consisting of stilbenes, coumarines, triazines, thiazoles, benzoxazoles, xanthenes, triazoles, oxazoles, thiophenes, pyrazolines, derivatives of naphthalene dicarboxylic acids, derivatives of heterocyclic dicarboxylic acids, derivatives of cinnamic acid and mixtures thereof.

25. The composition of claim 22, wherein said solvent is selected from the group consisting of water, polyethylene glycol, methyl methacrylate, glycols, glycerol, trialkyamines, vinyl alcohol, urea, $C_1$ to $C_4$ alcohols, and mixtures thereof.

26. The composition of claim 22, further comprising one or more components selected from the group consisting of buffering agents, thickening agents and surfactants.

27. The composition of claim 26, wherein said thickening agent comprises polymethyl methacrylate.

28. The composition of claim 22, wherein said vapor generating component is present in an amount of from about 5% to about 80% by weight of the composition.

29. The composition of claim 22, wherein said fluorescent dye component is present in an amount of from about 0.05% to about 0.5% by weight of the composition.

30. The composition of claim 22, wherein said solvent component is present in an amount of from about 20% to about 90% by weight of the composition.

31. The composition of claim 22, further comprising a thickening agent present in an amount of from about 0.05% to about 5% by weight of the composition.

* * * * *